US007032654B2

(12) United States Patent
Wand et al.

(10) Patent No.: US 7,032,654 B2
(45) Date of Patent: Apr. 25, 2006

(54) PLATE HEAT EXCHANGER WITH ENHANCED SURFACE FEATURES

(75) Inventors: Steven Michael Wand, York, PA (US); Brian James Emery, York, PA (US); James Eric Bogart, Glen Rock, PA (US)

(73) Assignee: FlatPlate, Inc., York, PA (US)

( * ) Notice: Subject to any disclaimer, the term of this patent is extended or adjusted under 35 U.S.C. 154(b) by 0 days.

(21) Appl. No.: 10/643,689

(22) Filed: Aug. 19, 2003

(65) Prior Publication Data

US 2005/0039898 A1 Feb. 24, 2005

(51) Int. Cl.
*F28F 13/02* (2006.01)
*F28F 3/06* (2006.01)

(52) U.S. Cl. ..... 165/133; 165/166; 165/167; 165/907

(58) Field of Classification Search ..... 165/166, 165/167, 133, 907, 104.26
See application file for complete search history.

(56) References Cited

U.S. PATENT DOCUMENTS

| | | | | |
|---|---|---|---|---|
| 2,616,671 | A * | 11/1952 | Wakeman | 165/167 |
| 3,049,796 | A | 8/1962 | Pall | |
| 3,157,229 | A * | 11/1964 | Wennerbert | 165/167 |
| 3,523,577 | A | 8/1970 | Milton | |
| 3,669,186 | A | 6/1972 | Schauls | |
| 3,681,843 | A * | 8/1972 | Arcella et al. | 165/104.26 |
| 4,130,233 | A | 12/1978 | Chisholm | |
| 4,201,263 | A | 5/1980 | Anderson | |
| 4,434,842 | A | 3/1984 | Gregory | |
| 4,458,748 | A | 7/1984 | Yamada et al. | |
| 4,470,455 | A | 9/1984 | Sacca | |
| 4,616,391 | A | 10/1986 | Cunningham et al. | |
| 4,660,630 | A | 4/1987 | Cunningham et al. | |
| 4,692,978 | A | 9/1987 | Cunningham et al. | |
| 4,729,155 | A | 3/1988 | Cunningham et al. | |
| 4,854,382 | A * | 8/1989 | Funke | 165/167 |
| 4,872,578 | A * | 10/1989 | Fuerschbach et al. | 165/167 |
| 5,193,611 | A * | 3/1993 | Hesselgreaves | 165/166 |

(Continued)

FOREIGN PATENT DOCUMENTS

| | | | | |
|---|---|---|---|---|
| EP | 0111459 A2 * | 6/1984 | | 165/166 |

(Continued)

OTHER PUBLICATIONS

Longo et al., Development of Innovative Plate Heat Exchangers for Refrigeration Application, Symposium, Apr. 2003, ICR0062, International Congress of Refrigeration 2003, Washington, D.C., USA.

*Primary Examiner*—Leonard R. Leo
(74) *Attorney, Agent, or Firm*—McNees Wallace & Nurick LLC

(57) ABSTRACT

A plate heat exchanger includes a plurality of plates for providing a flow path for two fluids. The plate heat exchanger has an inlet and an outlet for each of the two fluids, wherein facing surfaces of two adjacent plates of the plurality of plates defines a flow path for a first fluid. The opposite surface of one of the two adjacent plates and a facing surface of another adjacent plate from the plurality of plates provides a flow path for a second fluid. The first fluid and the second fluid flowing along their respective flow paths are maintained in thermal communication with each other. A plurality of surface features associated with at least a portion of one surface of at least one of the plates provides enhanced heat transfer between the two fluids passing along adjacent plates.

21 Claims, 12 Drawing Sheets

U.S. PATENT DOCUMENTS

| | | | | |
|---|---|---|---|---|
| 5,383,518 | A | 1/1995 | Banks et al. | |
| 5,462,113 | A | 10/1995 | Wand | |
| 5,465,484 | A | 11/1995 | Banks et al. | |
| 5,531,269 | A | 7/1996 | Dahlgren | |
| 5,697,430 | A | 12/1997 | Thors et al. | |
| 5,832,736 | A | 11/1998 | Yoshioka et al. | |
| 5,954,126 | A * | 9/1999 | Armbruster | 165/167 |
| 5,988,269 | A | 11/1999 | Karlsson et al. | |
| 5,996,686 | A | 12/1999 | Thors et al. | |
| 6,016,865 | A | 1/2000 | Blomgren | |
| 6,039,112 | A * | 3/2000 | Ruppel et al. | 165/167 |
| 6,230,408 | B1 | 5/2001 | Ehrfeld et al. | |
| 6,305,466 | B1 | 10/2001 | Andersson et al. | |
| 6,386,278 | B1 | 5/2002 | Schulz-Harder | |
| 6,394,178 | B1 | 5/2002 | Yoshida et al. | |
| 2001/0030041 | A1 * | 10/2001 | Boneberg et al. | 165/166 |
| 2004/0011515 | A1 | 1/2004 | Matsushima | |
| 2004/0226704 | A1 | 11/2004 | Sella et al. | |

FOREIGN PATENT DOCUMENTS

| | | | | |
|---|---|---|---|---|
| EP | 0 611 941 | A2 | 2/1994 | |
| EP | 1 394 491 | | 3/2004 | |
| GB | 1 395 013 | | 5/1975 | |
| JP | 57187594 | A * | 11/1982 | 165/166 |
| WO | WO 01/93976 | A2 | 12/2001 | |

* cited by examiner

PLATE HEAT EXCHANGER WITH ENHANCED SURFACE FEATURES

FIELD OF THE INVENTION

The present invention is directed to a plate heat exchanger, and more specifically to plate heat exchanger having surface features for providing enhanced heat transfer between the fluids flowing through the heat exchanger.

BACKGROUND OF THE INVENTION

Plate heat exchangers are one of several components in cooling and heating systems. They are an important component as the plate heat exchangers are used to place two or more fluids in heat exchange relationship with one another, acting as either a condenser or evaporator, depending upon the desired application. In other words, one of two or more fluids is preferably condensed or evaporated. Preferably, one of the fluids is a refrigerant. The plate heat exchangers are typically used in combination with a compressor, expansion valves and blowers to heat or cool a space. Plate heat exchangers are desirable to use due to their compact construction and convenient installation.

The plate heat exchanger typically is a sealed device that has an inlet and an outlet for each of the two or more fluids, which are isolated from one another, that circulate through the heat exchanger. The sealed device typically includes a plurality of pressed plates, the patterns of the pressed plates typically taking the form of a herringbone defining "V-ridge" cross sections of alternating apexes, with apertures being formed adjacent the ends in the pressed plates to permit flow of the two or more fluids. The plates are configured so that by alternately rotating the plates end-for-end, the apertures are configured to provide separate flow passages for each of the fluids between plate pairs, one fluid possibly having multiple flow passages between a predetermined number of plate pairs. The end-for-end rotation also provides opposed herringbone patterns between adjacent plate pairs. By virtue of this staggered arrangement, the opposed herringbone patterns intermittently contact each other along the respective apexes of the V-ridges of the herringbone patterns, each contact region being referred to as a node. This staggered interface between each plate pair defines a tortuous flow passage of constantly changing direction and cross-section, providing more efficient thermal communication between different fluids flowing along adjacent flow passages while maximizing fluid contact with the surfaces of the plates.

The above geometry exhibits improved thermal communication values, typically referred to as a refrigerant side heat transfer coefficient, of approximately 380 BTU/° F./ft$^2$/hr at typical design conditions to the heat transfer fluids passing through the plate heat exchanger. However, the value of this coefficient is significantly less than that achieved by other heat exchanger constructions, such as by enhanced tubes having a first fluid or refrigerant flowing therethrough, the tubes being passed through a vessel containing a second fluid passing over the tubes, and vice versa.

Therefore, there is a need for a plate heat exchanger construction having improved heat transfer coefficient values.

SUMMARY OF THE INVENTION

The present invention relates to an improvement to a plate heat exchanger including a plurality of substantially parallel plates having high thermal conductivity, each plate having opposed surface and perimeter flanges, for providing at least one flow path for each of at least two fluids. The facing surface of the plates, that is to say, surfaces of adjacent plates that face each other, and perimeter flanges of these plates, when assembled together, define a flow path for each fluid of the at least two fluids. Upon assembly, the perimeter flanges contact one another to form a flow path boundary, or fluid boundary, and interspaces between the adjacent plates provide the channels for flow of the fluids. One plate of the at least one plate of adjacent plates will have opposed surfaces in contact with two different fluids of the at least two fluids. The surfaces of this plate provide a portion of the flow path boundary for these fluids, a surface of a plate adjacent to each of the opposed surfaces also providing a portion of the flow path boundary for these fluids. Plates having two different fluids on opposed surfaces should be constructed of a material of high thermal conductivity so as to provide good thermal communication between the fluids on opposed sides of the plate in contact with the surfaces permitting excellent heat transfer. Clearly, in a stack of plates, each plate except the end plates will have fluids flowing on both sides of opposed surfaces, so that each plate in the stack should be of a material of high thermal conductivity. The end plates have air on one side. Although air strictly is a fluid, as used herein, air is not considered one of the fluids utilized for heat transfer in the heat exchanger of the present invention, as air can act as a good insulator. Thus, the end plates do not have to be of a material of high thermal conductivity and can be a lower cost material such as a carbon steel, although they typically are constructed of the same material as the other plates in the stack. The plate heat exchanger also has an inlet and an outlet for each of the at least two fluids, the inlet and outlet for each fluid being in fluid communication with each flow path for the fluids so that the fluids can enter the flow paths, traverse them and leave. Facing surfaces of two adjacent plates of the plurality of substantial parallel plates define a flow path for a first fluid of the at least two fluids. The plate heat exchanger includes a plurality of surface microfeatures in fluid communication with at least a portion of at least one flow path of at least one fluid, the plurality of surface microfeatures providing enhanced heat transfer between the at least two fluids passing along and over opposite surfaces of the plate, the fluids flowing through channels formed by adjacent plates. As used herein, the term surface microfeatures includes microfeatures having a preselected geometry and having a size of 0.050 inches and less. Surface microfeatures do not include ridges (including large dimples or corrugations) formed in the plates, which would be considered macrofeatures, but would include the small geometric features formed on or in the surfaces of the ridges, corrugations or dimples.

The present invention further relates to an improvement to a plate heat exchanger including a plurality of plates for providing at least one flow path for each of at least two fluids. The plate heat exchanger has an inlet and an outlet for each of the at least two fluids in fluid communication with each flow path for each fluid. Facing surfaces of two adjacent substantially parallel plates of the plurality of plates define a flow path for a first fluid of the at least two fluids. The opposite surface of one of the two adjacent plates and a facing surface of another third adjacent plate from the plurality of plates provides a flow path for a second fluid of the at least two fluids flowing through the plurality of plates providing thermal communication between the first and the second fluid of the at least two fluids. The plate heat exchanger includes at least one insert member having a plurality of surface features within at least a portion of at least one flow path of at least one fluid for providing enhanced heat transfer between the at least two fluids passing along adjacent plates.

The present invention also relates to a method for providing an enhanced heat transfer surface for use with a plate heat exchanger including a plurality of plates for providing at least one flow path for each of the at least two fluids. The plate heat exchanger has an inlet and an outlet for each of the at least two fluids in fluid communication with each flow path for one of the fluids. Facing surfaces of two adjacent plates of the plurality of plates define a flow path for a first fluid of the at least two fluids. The opposite surface of one of the two adjacent plates and a facing surface of another third adjacent plate from the plurality of plates provides a flow path for a second fluid of the at least two fluids flowing through the plurality of plates thereby providing thermal communication between the first and the second fluid of the at least two fluids across opposed surfaces of a plate, the step includes forming a plurality of surface features associated with at least a portion of at least one surface of at least one of the plates.

The present invention further relates to a method for providing an enhanced heat transfer surface for use with a plate heat exchanger including a plurality of plates, each plate having opposed surfaces and perimeter flanges, for providing at least one flow path for each of at least two fluids. The facing surfaces, that is surfaces of adjacent plates that face each other, and the perimeter flanges of adjacent plates define a flow path for each fluid. The opposed surfaces of at least one plate of the pair of adjacent plates provide a common flow path boundary for two of the fluids. The plate is constructed of a material of high thermal conductivity so that heat is readily transferred across the common flow path boundary and providing thermal communication between the two fluids. The plate heat exchanger has an inlet and an outlet for each of the at least two fluids, each flow path for one of the fluids in fluid communication with an inlet an outlet for the fluid. The opposite surface of one of the two adjacent plates and a facing surface of a third plate adjacent said opposite surface from the plurality of plates provides a flow path for a second fluid of the at least two fluids flowing through the plurality of plates thereby providing thermal communication between the first and the second fluid of the at least two fluids across a plate. A plurality of surface microfeatures are provided to enhance heat transfer across the opposed surfaces of the plate between at least two fluids passing through adjacent flow paths along adjacent plates. These surface microfeatures are in the flow path of at least one of the fluids. The surface microfeatures can be placed in the flow path in several ways. The microfeatures may be added to at least a portion of one of the flow path surface of one of the plates. This can be done, for example, by deposition. By adding a material to the surface of the plate, the surface microfeatures can be added as depressions below the surface of the plate or as raised nodes projecting above the surface. The microfeatures can also be formed into the surface of the plate such as by rolling. The microfeatures can be added to the flow path by inserting a member such as a mesh or perforated plate into the flow path itself The mesh or perforated plate can be positioned in the flow path via spacer or the mesh or perforated plate can be bonded to the surface of one or both plates forming the flow path.

An advantage of the present invention is a significant increase in the refrigerant side heat transfer coefficient and overall heat transfer coefficient of the plate heat exchanger as compared to current state of the art plate heat exchanger constructions.

Another advantage of the present invention is the ability to reduce the size of a heat exchanger unit without affecting the capacity of the unit. Conversely, the present invention produces a heat exchanger unit with increased capacity without the need to increase the size of the heat exchanger unit.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
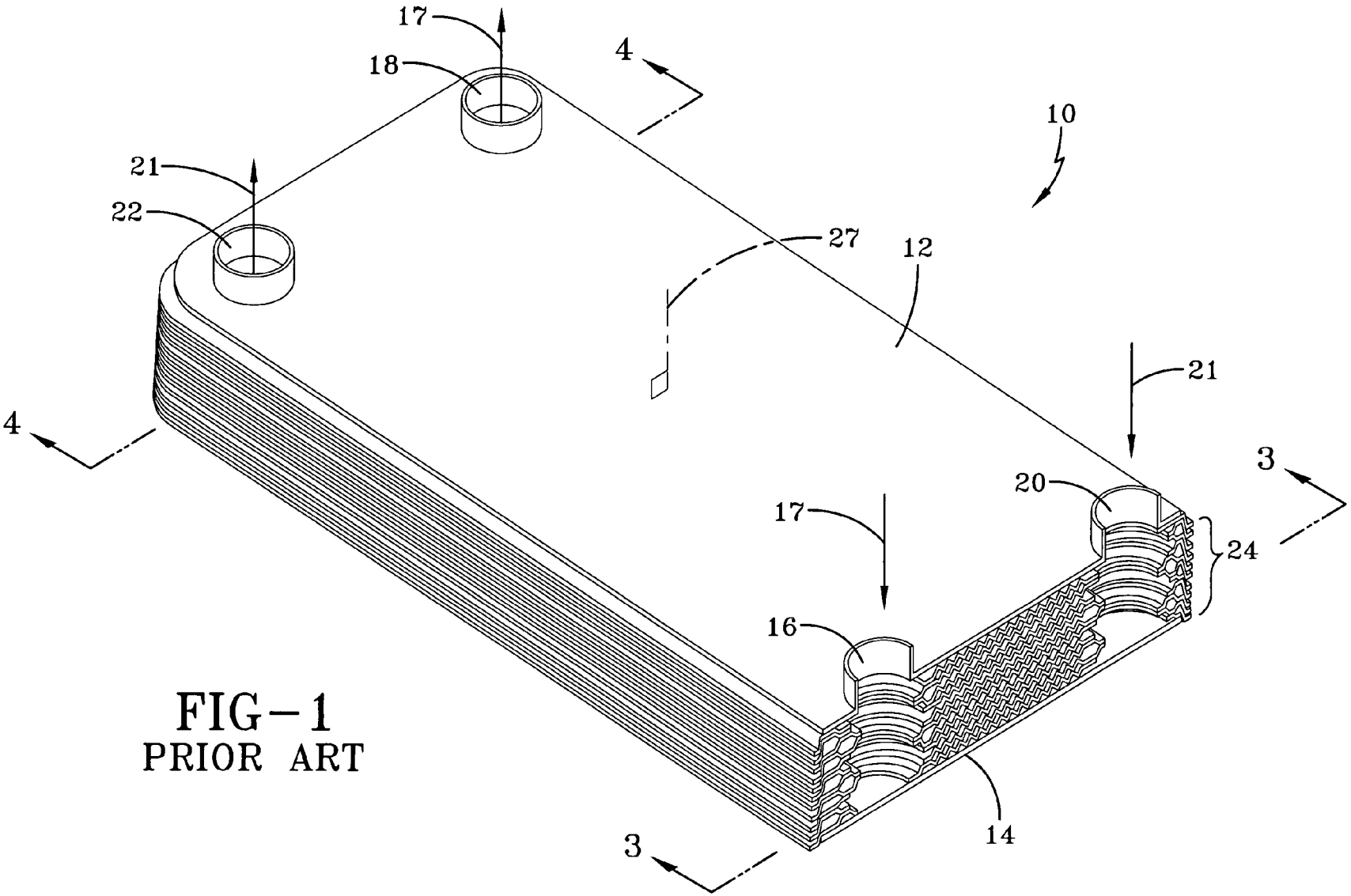
FIG-1 PRIOR ART
FIG. 1 is a perspective view of a prior art plate heat exchanger.

The novel surface features of the present invention are configured for use with a prior art plate heat exchanger 10 depicted in FIGS. 1–7. Such a heat exchanger is similar to a heat exchanger set forth in U.S. Pat. No. 5,462,113 issued on Oct. 31, 1995 incorporated herein by reference. As used herein, the term surface microfeature refers to extremely small geometric attributes, such as indentations formed in a plate surface or protrusions formed on a plate surface, and having a size of 0.050 inches or less. The heat exchanger 10 includes a plurality of formed plates 24 comprising a high thermal conductively material such as copper disposed between a top plate 12 and a bottom plate 14 providing separated flow passages 44 for a first fluid 17 and a second fluid 21 while simultaneously providing thermal communication between the first fluid 17 and the second fluid 21. While atypical, the first and second fluids 17, 21 may have the same composition. Typically, a diametrically opposed inlet port 16 and an outlet port 18 are formed in the top plate 12 permitting the first fluid 17 to access the plates 24, and similarly, a diametrically opposed inlet port 20 and an outlet port 22 are formed in the top plate 12 permitting the second fluid 21 to also access the plates 24. Alternately, it may be advantageous to reverse the orientation of one of the pair of inlet/outlet ports so that the first pair and second pair of fluid inlets/outlets are located on opposite ends of the heat exchanger 10.

Figure 5:
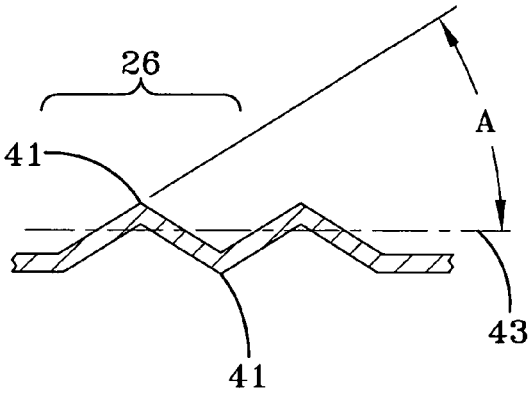
FIG-5 PRIOR ART
FIG. 5 is a cross-section of a single herringbone V-ridge of the prior art plate heat exchanger taken along line 5—5 from FIG. 2 that is transverse to the direction of the V-ridge.
Figure 2:
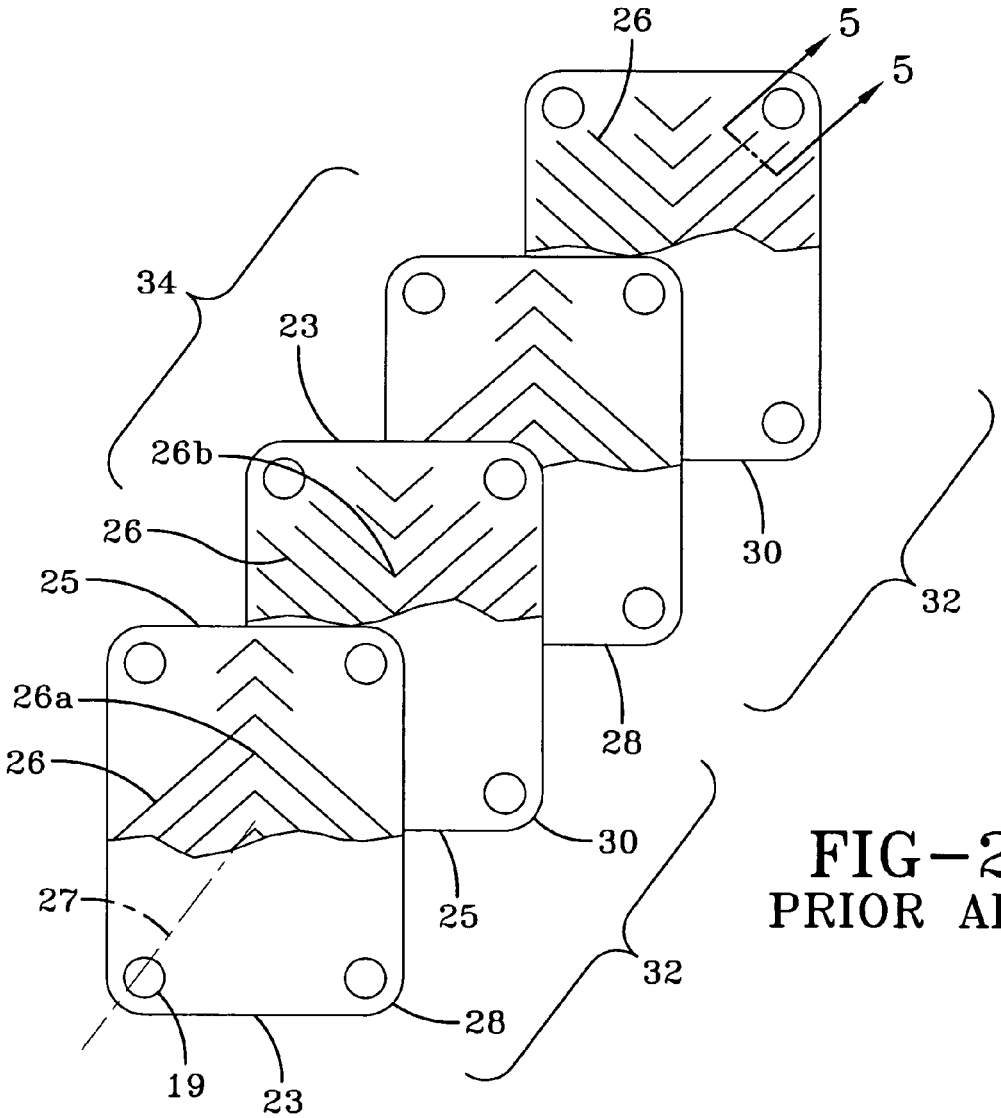
FIG-2 PRIOR ART
FIG. 2 is a schematic exploded plan view of a plate arrangement of the prior art plate heat exchanger.
Figure 3:
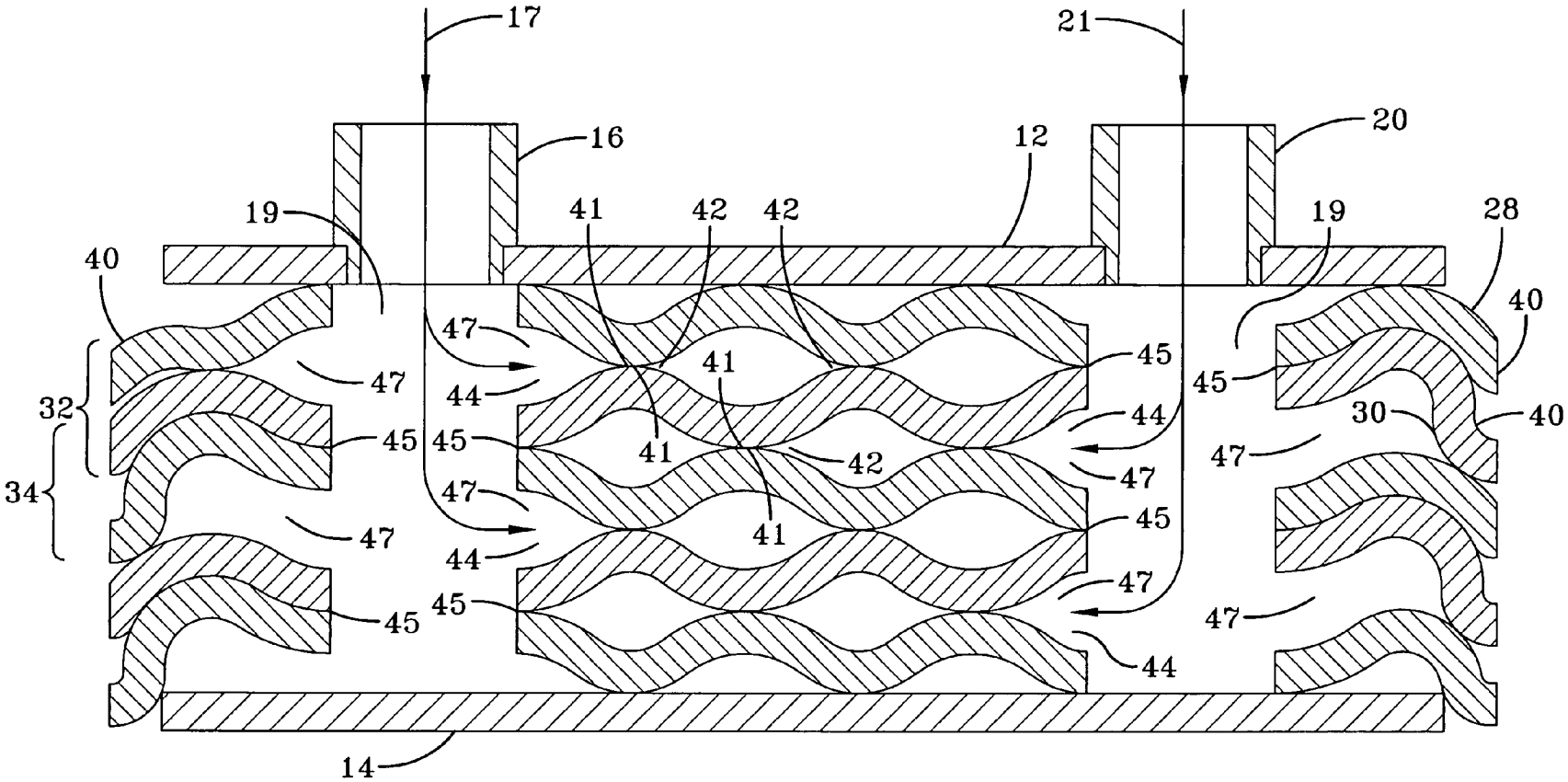
FIG-3 PRIOR ART
FIG. 3 is a cross-section of the prior art plate heat exchanger taken along line 3—3 from FIG. 1.

Each of the formed plates 24 includes alternately arranged plates 28, 30, each having opposed ends 23, 25. Typically, the only difference between the plate 28 and the plate 30 is that the ends 23, 25 are reversed, or stated alternatively, that plate 28 is rotated 180 degrees about an axis 27, which is perpendicular to the surface of top plate 12. Each plate 28, 30 includes a plurality of apertures 19 which align with respective inlet/outlet ports when the plates are installed in the heat exchanger 10. Depicted in an arrangement that includes inlet/outlet ports 16, 18, 20, 22, it being understood that additional inlet/outlet ports can be included, such as when three or more heat exchange fluids are utilized. Formed in the surface of plate 28, 30 are a plurality of V-ridges 26, also referred to as corrugations, typically arranged in a herringbone configuration to provide a tortuous flow passage 44 of changing direction and cross-section when arranged in a plate pair 32, 34 as discussed below. These ridges may take other forms such as U-ridges, sinusoidal shapes, square shapes, etc., but V-ridges are preferred. The flow passage provides more efficient thermal communication between different fluids flowing along adjacent flow passages 44. Referring specifically to FIG. 5, which is a view taken in a direction transverse to the direction of the V-ridge 26, each V-ridge 26 defines a "V" shaped cross-section extending to an apex 41, also referred to as a peak. As used herein, the apex 41 may extend upward or may extend downward from a center axis 43 as depicted in FIG. 5. The plates 28, 30 extend outwardly to a flange 40 formed at the plate edges which defines the periphery of the plates 28, 30. The flanges 40 of the stacked plates 28, 30 physically touch one another and form a barrier to fluid flow when and form a barrier to fluid flow stacked to form heat exchanger 10.

Figure 7:
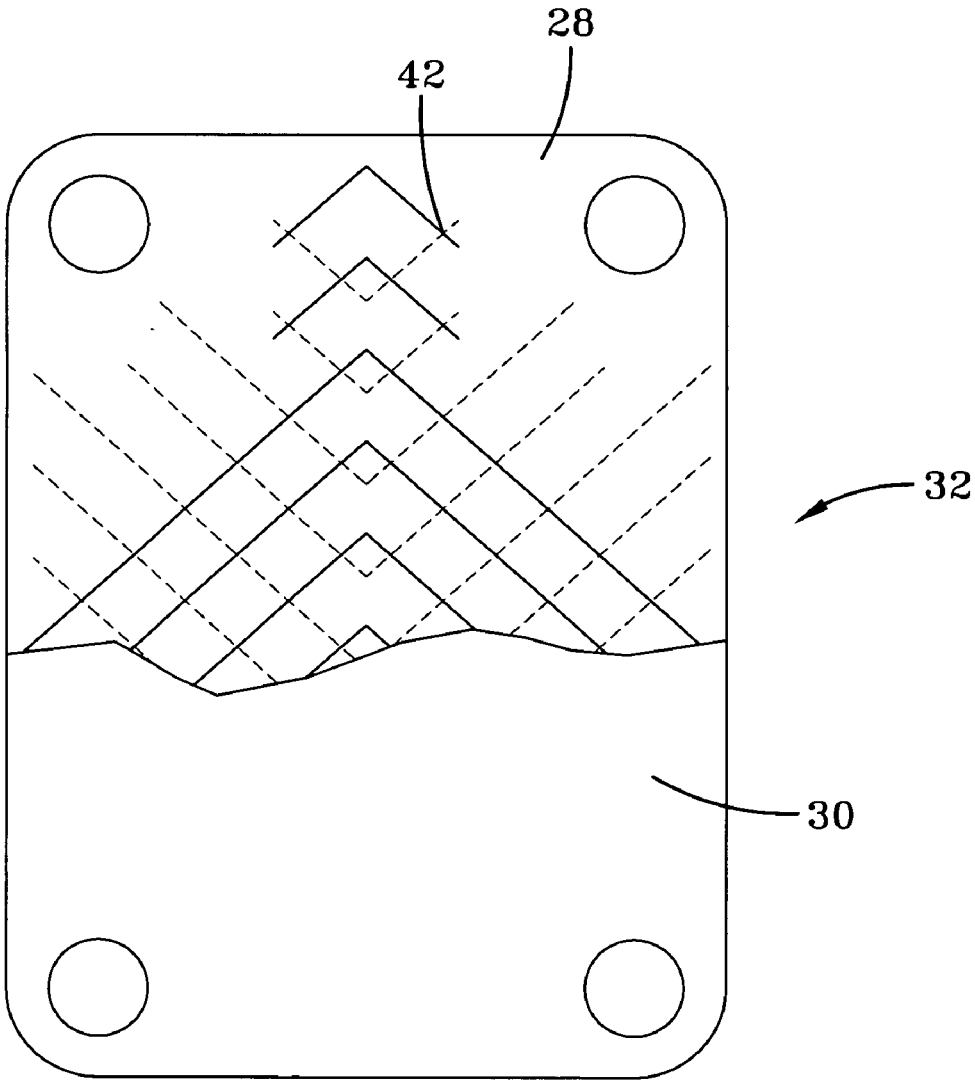
FIG-7 PRIOR ART
FIG. 7 is a plan view of a plate pair of the prior art heat exchanger.

Positioning plate 28 adjacent plate 30 with flanges 40 in contact collectively defines a plate pair 32. Thus, positioning the plate 30 over or under the plate 28 collectively defines a plate pair 34. For purposes of surface orientation, only in discussing the plate arrangement in order to understand the present invention the term "upper surface" refers to the surface of a plate that faces the top plate 12, and the term "lower surface" refers to the surface of a plate that faces bottom plate 14. It being understood that the heat exchanger may be placed in a variety of physical orientations, including vertical, horizontal and any position therebetween. Therefore, the lower surface of plate 28 and the upper surface of plate 30 face each other. Referring again to FIG. 2, plates 28 and plates 30 have V-ridges, the ridges in the surface of plate 28 being 180° to the ridges in the surface of plate 30. That is, ridge 26 of plate 28 defines an inverted "V", or junction 26*a* of ridge 26 is closer to end 25 of plate 28 than the other portions of the ridge 26. Similarly, ridge 26 of the plate 30 defines a "V", or the junction 26*b* of the ridge 26 is closer to end 25 of plate 30 than the other portions of the ridge 26. However, the ends 25 of the plates 28, 30 are opposite each other. Referring to FIG. 7, when plate 28 is positioned so that its flanges contact the flanges of plate 30 to form the plate pair 32, the apexes 41 (FIG. 5) along each V-ridge 26 of each plate 28, 30 alternately physically contact each other to form nodes 42. Likewise, when the plate 30 is placed in contact with the plate 28 to form the plate pair 34, the apexes 41 (see FIG. 5) along each V-ridge 26 of each plate 28, 30 alternately physically contact each other to form nodes 42.

Figure 4:
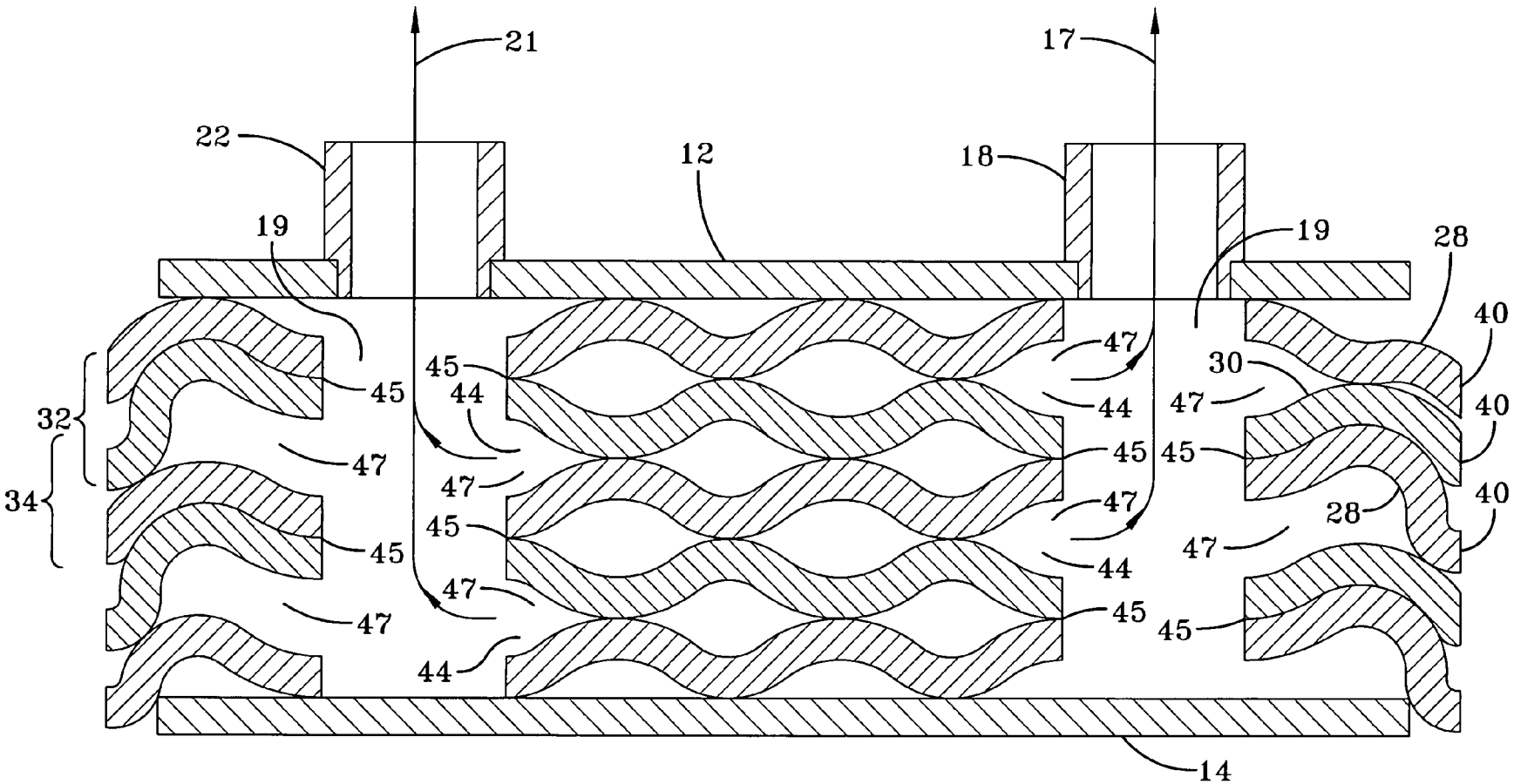
FIG-4 PRIOR ART
FIG. 4 is a cross-section of the prior art plate heat exchanger taken along line 4—4 from FIG. 1.
Figure 6:
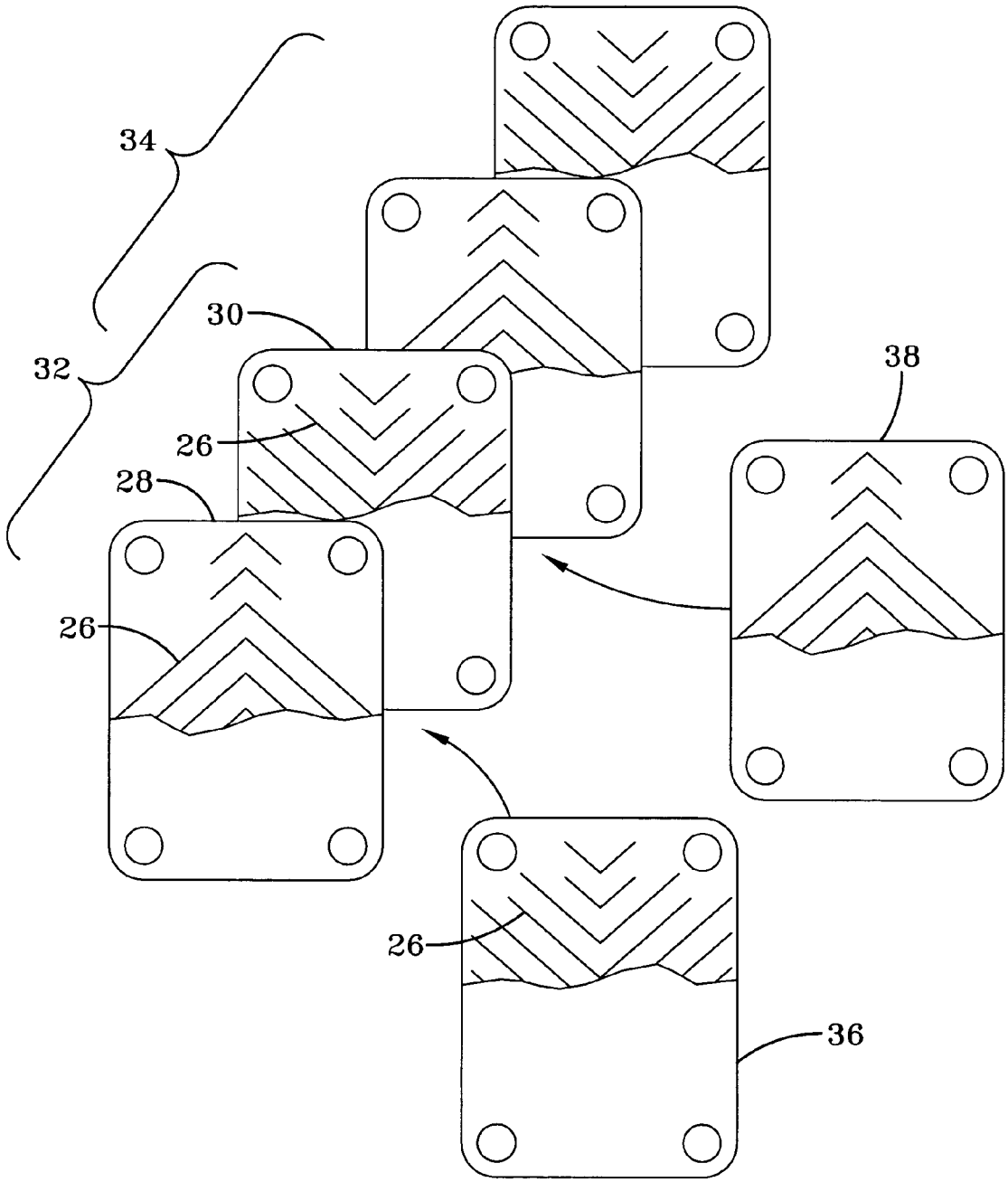
FIG-6 PRIOR ART
FIG. 6 is a schematic exploded plan view of a further plate arrangement of the prior art plate heat exchanger.

The alternately positioned plates 28, 30 (FIGS. 1, 3, 4) which likewise define plate pairs 32, 34 provide separate flow passages 44 for the first fluid 17 and the second fluid 21. As is evident, a plate may be shared by a plate pair. For example, plate pair 32 may include plates 28, 30 and plate pair 34 may include plates 30, 28. Stated alternatively, stacked plate pairs 32, 34 may include an arrangement of plates comprising a sequence of plates 28, 30, 28. This separated flow is achieved by the apertures 19 of the plates 28, 30 being alternately configured to provide alternate spaced arrangements 47 and closed arrangements 45 between adjacent plates 28, 30. For example, referring to FIGS. 1, 3, and 4, plate pair 32 defines the spaced arrangement 47 along the aperture 19 which aligns with the first fluid inlet 16 (FIG. 3) to permit the first fluid 17 entering the first fluid inlet 16 to flow through the spaced arrangement 47, then into the passage 44. The first fluid 17 continues to flow substantially parallel along the plate along flow passage 44, around contacting apexes 41 that define nodes 42. Since the peripheral flange 40 provides a fluid tight seal, the only outlet for fluid 17 from the passage 44 is the other spaced arrangement 47 that is adjacent to the aperture 19 which is aligned with the first fluid outlet 18 (FIG. 4). Thus, after passing from passage 44 through the spaced arrangement 47 adjacent the first fluid outlet 18, the first fluid 17 exits the heat exchanger 10 by passing through the first fluid outlet 18. The other two apertures 19 defined by the plate pair 32 have a closed arrangement 45 to prevent the flow of the first fluid 17 therethrough.

Similarly, the plate pair 34 defines the spaced arrangement 47 along the aperture 19 which aligns with the second fluid inlet 20 (FIG. 3) to permit the second fluid 21 entering the second fluid inlet 20 to flow through the spaced arrangement 47 then into the passage 44. The second fluid 21 continues to flow substantially parallel along the plate along flow passage 44, around contacting apexes 41 that define nodes 42. Since the peripheral flange 40 provides a fluid tight seal, the only outlet for fluid 21 from the passage 44 is the other spaced arrangement 47 that is adjacent to the aperture 19 which is aligned with the second fluid outlet 22 (FIG. 4). Thus, after passing from passage 44 through the spaced arrangement 47 adjacent the second fluid outlet 22, the second fluid 21 exits the heat exchanger 10 by passing through the second fluid outlet 22. The other two apertures 19 defined by the plate pair 34 have a closed arrangement 45 to prevent the flow of the second fluid 21 therethrough.

Typically, there are two constructions for plate heat exchangers, brazed and nonbrazed, either of which will benefit from the novel enhanced surface of the present invention. A nonbrazed construction typically employs some type of fastening means, such as nuts and bolts (not shown), or welding, to collectively secure the plates in position during operation of the plate heat exchanger to counteract pressure exerted by the fluids. A brazed construction is depicted in FIG. 1. In a preferred embodiment, referring to FIG. 6 which is otherwise identical to FIG. 2, foil plates 36, 38 that are comprised of a brazeable material, preferably copper, copper alloy, or nickel alloy, are inserted between each plate pair 32, 34 and adjacent both the top and bottom plates 12, 14. Once the foil plates 36, 38 are inserted and the plates sufficiently pressed together, the heat exchanger 10 is heated to a predetermined temperature below the melting point of plates 28, 30, but above the melting point of inserts 36, 38 for sufficient duration to melt the foil plates 36, 38. Due to capillary action, the molten metal, preferably copper, is drawn to regions of the plates that are in contact with each other, such as the nodes 42 and the peripheral flanges 40. The plates typically comprised of copper, form metallic bonds along these regions or nodes which are fluid tight (i.e., along the peripheral flanges), and provide greatly increased structural support, normally expressed in terms of burst pressure, which can approach 3,000 psi and sufficient to withstand pressures from the fluids 17, 21 and meet safety code requirements.

Referring to FIGS. 1–4, the heat exchanger 10 may be configured as an evaporator in an HVAC system, and the fluid 17, such as water, induces evaporation of the fluid 21 which typically is a refrigerant. Fluid 17 enters the fluid inlet 16 and passes through the spaced arrangement 47 before entering the passage 44 between the plates 28, 30 of the plate pair 32. Preferably, fluids are selected in pairs such that the boiling point of one of the liquids is below the boiling point of the other liquids. Fluid 21 enters the fluid inlet 20 and passes through the spaced arrangement 47 before entering the passage 44 between the plates 28, 30 of the plate pair 34. Since the plate pairs 32, are adjacent, they share a common plate 30; the fluid 17 passes along one surface, the upper surface as depicted, of the plate 30 while the fluid 21 passes along the opposite or lower surface of the plate 30 as depicted. By virtue of the thermal communication between the fluids 17, 21 through the plate 30, heat is transferred via conduction and bubbles (not shown) form due to nucleate boiling of the fluid 21 along the lower surface of the plate 30 (in an evaporative application). (Alternatively, in a condensing application droplets form as gaseous fluid is cooled.) Regardless of the application, the arrangement of the plates enhances conduction between the fluids across the plates to promote the physical change (or phase changes) either from gas to liquid or liquid to gas. This physical change of state is accomplished by further absorption of heat (heat of evaporation) or release of heat (heat from condensation), which are well known thermodynamic principles.

The present invention provides a plurality of surface microfeatures modifying flow in the passages between plate surfaces for providing enhanced heat transfer between the fluids passing in thermal communication with each other in plate heat exchangers. The analysis involving the behavior of the fluids flowing in plate heat exchangers is extremely complex and not yet fully understood, especially when the fluids undergo phase changes, which is even further complicated by the effects associated with the surface microfeatures of the present invention. However, refrigerant side heat transfer coefficients of at least approximately 700 BTU/° F./ft$^2$/hr (at typical design conditions), which is roughly twice the amount of conventional plate heat exchangers, such as depicted in FIGS. 1–7, have already been achieved by virtue of these novel surface microfeatures. At least a portion of this significant increase in the heat transfer coefficient may be attributed to improved nucleate boiling or condensated droplet formation, during which superheated bubbles are formed along the surface of the enhanced heat transfer surface of the evaporating fluid as previously described. The presence of the surface microfeatures of the present invention appears to, at the least, provide significantly enhanced nucleate boiling by providing a plurality of sites that are favorable for the formation of the superheated bubbles, and simultaneously promote improved wetting of the surface in evaporating operation. Yet in condensing operation, this surface enhancement can also provide additional heat transfer surface area, faster removal of refrigerant from plate surfaces by capillary forces and by providing nucleation sites at which droplets can form from supercooled vapors, thereby increasing the heat transfer coefficient. For evaporation, these advantageous formation locations not only permit initial nucleate formation, but also appears to retain the nucleate for a period of time, permitting the nucleate to increase in size some amount prior to becoming entrained in the fluid flow stream. For the purposes of simplifying the discussion, the remainder of this description is set forth in terms of formation of nucleates as gas bubbles during an evaporation process. However, it will be understood by those skilled in the art that the present invention provides the same improvements for the phase change in which refrigerant is condensed into liquid from its gaseous state as these sites assist in the nucleation of droplets.

Once the superheated bubble becomes entrained in the fluid flow stream, the space previously occupied by the bubble is replaced by liquid fluid, which restarts the nucleate boiling process at that location. Without wishing to be bound by theory, it is also believed that once bubble formation and entrainment initially occurs, the location of the initial bubble formation remains a favorable location for subsequent bubble formation by virtue of a portion of the bubble being left behind as a "seed." Another aspect of the present invention appears to optimize the volume of bubbles produced during the nucleate boiling stage, since permitting the size of the superheated bubbles to grow too large decreases the heat transfer coefficient. Further, it also believed that when sufficiently large bubbles are permitted to form, upon entrainment of the bubble in fluid flow stream, an insufficient amount of the bubble remains to act as a "seed" for subsequent bubble formation.

An additional believed advantageous aspect of the enhanced bubble formation previously discussed is the tendency to increase the amount of wetted surface of the heat exchanger plates 28, 30 by virtue of capillary action to further increase the heat transfer coefficient. Further, due to this enhanced capillary action, the angle "A" (FIG. 5), which has been limited to the range of about 22–30° F. in prior art constructions, may be increased to about 60 degrees or higher, which may provide further heat coefficient gains due to differences in flow behavior of the fluids provided by the increased angle A. Thus, for at least the reasons of enhanced heat transfer, including nucleate boiling and increased surface wettability, the novel surface microfeatures of the present invention provide a significant improvement in the art for plate heat exchangers.

Figure 8:
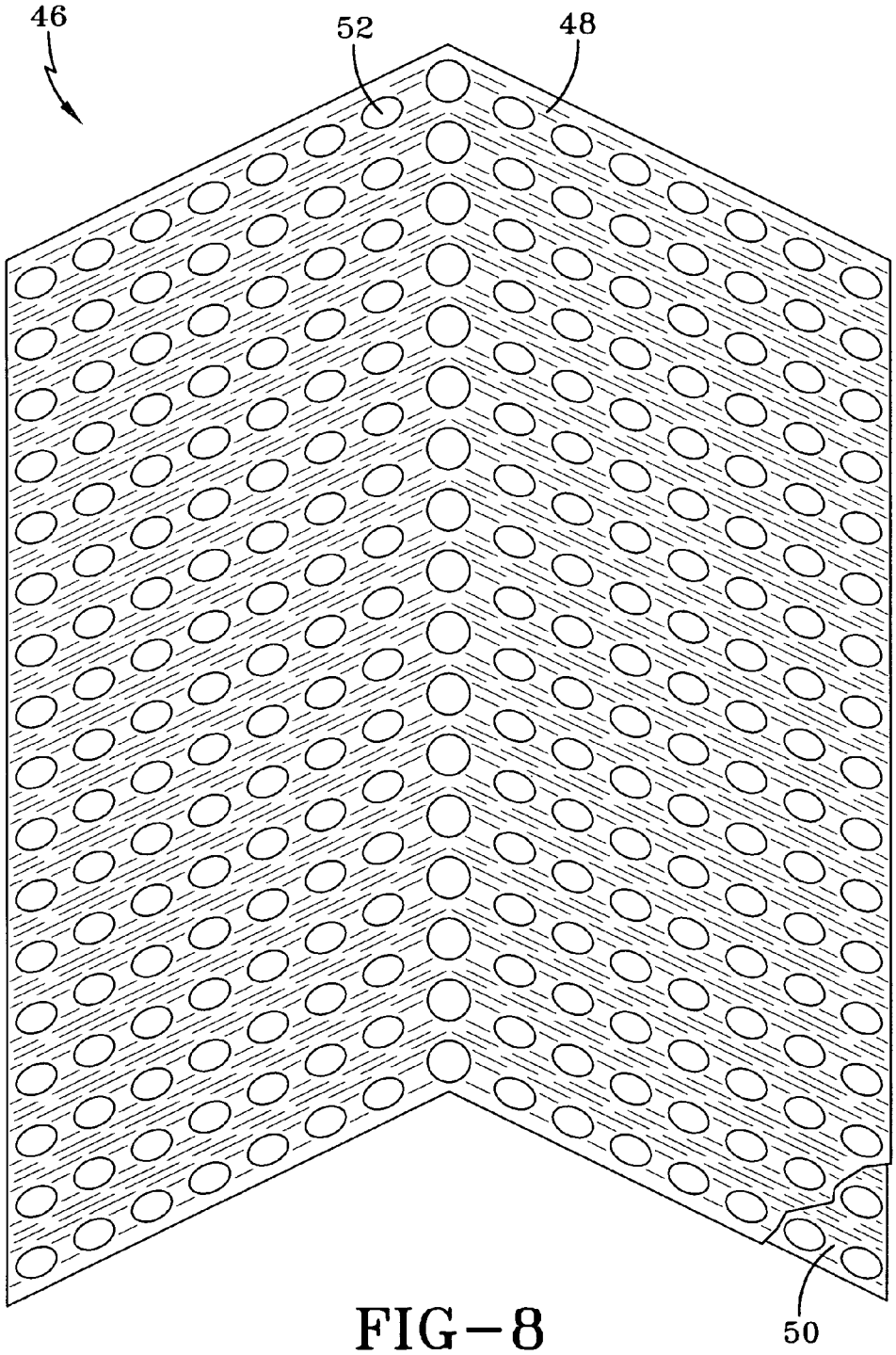
FIG. 8 is a plan view of a mesh insert of the present invention.
Figure 9:
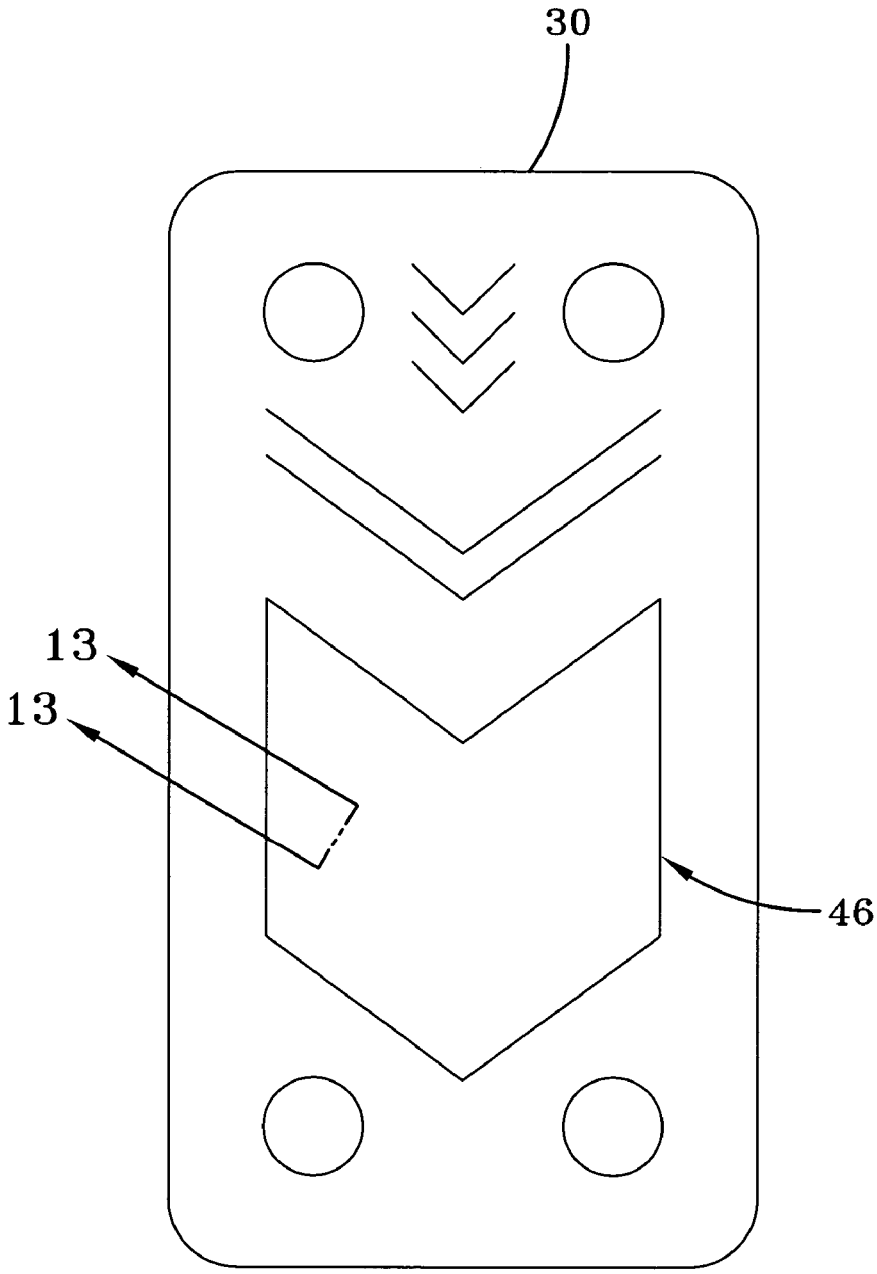
FIG. 9 is a plan view of the insert installed on a heat exchanger plate of the present invention.
Figure 10:
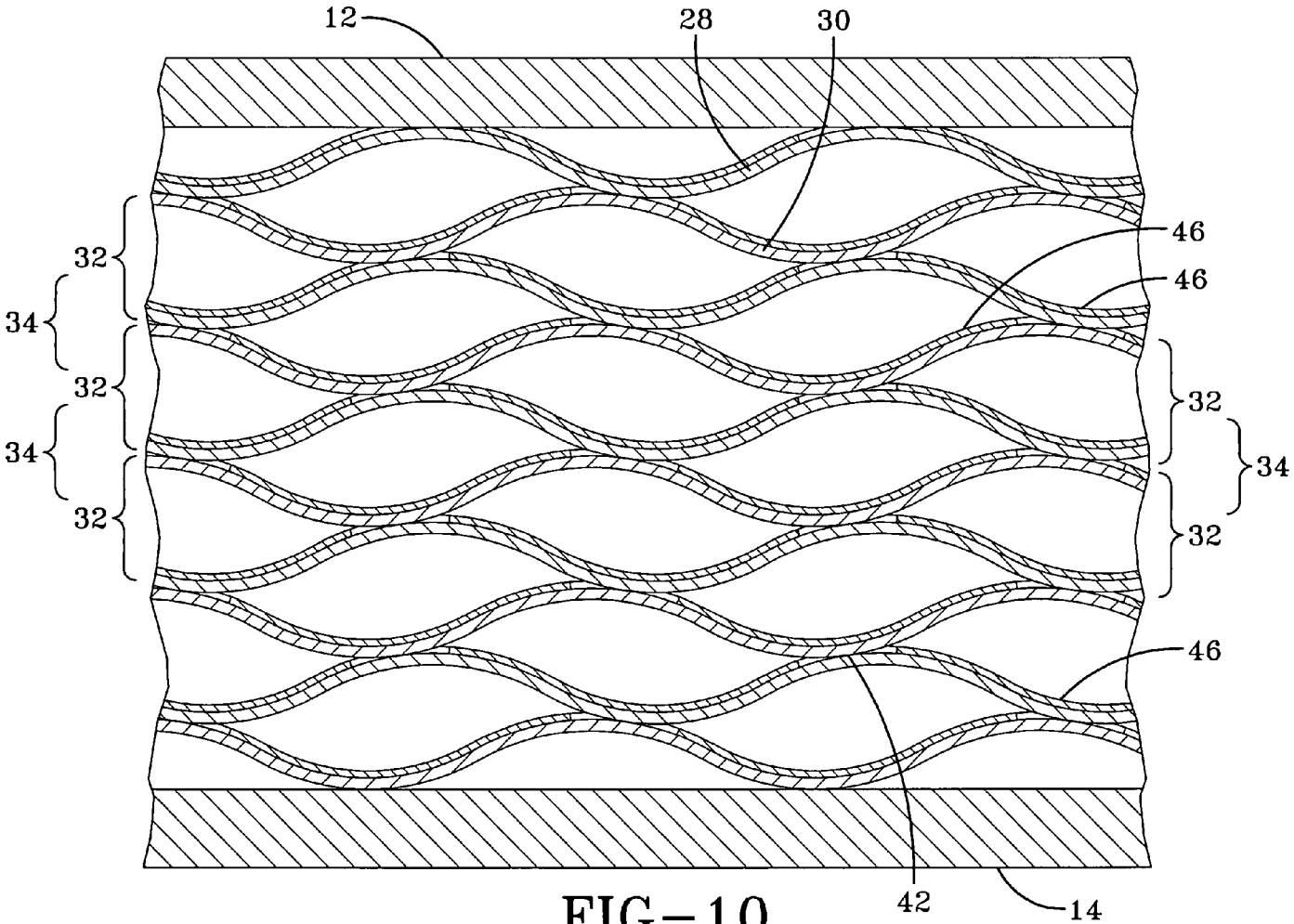
FIG. 10 is a partial cross-section of a plate heat exchanger similar to that of FIG. 3 except a plurality of mesh inserts have been inserted between alternate pairs of heat exchanger plates of the present invention.

Referring to FIGS. 8–10, the present invention includes an insert 46 comprising a mesh 48. Mesh 48 optionally may include a metallic backing layer 50, such as copper, for placement between plates 28, 30 of plate pair 32, 34. The insert 46 preferably has substantially the same formed V-ridge 26 profile and orientation as the plate, such as plate 30, onto which the insert 46 is placed so that the facing surfaces of the insert 46 and the plate 30 are substantially immediately adjacent or flush. Insert 46 is provided with a plurality of apertures 52 that are spaced to coincide with nodes 42. Thus, upon placing a first plate 28 over a second plate 30 and insert 46 there between, the apexes 41 of the plates 28, 30 physically touch, due to the node clearance apertures 52 formed in the insert 46. If desired, a second insert 46 having the same orientation as the plate 28 could be additionally inserted between the plate 28 and the plate 30 of the plate pair 32, so that the second insert 46 and the plate 28 are substantially immediately adjacent or flush. In other words, the insert 46 may be provided for each of the facing surfaces of the plate pairs 32, 34, if desired. Although the insert 46, or even two inserts 46 as described above, may be positioned between each of the adjacent plate pairs 32, 34, typically, inserts 46 are only employed between the facing surfaces of the plate pairs for fluid having a lower boiling point, such as a refrigerant. It is generally not desirable to use inserts 46 between the facing surfaces of the plate pairs for fluid having a higher boiling point, such as water, since the inserts 46 will serve to restrict flow by creating a resistance to flow while providing no benefit in terms of nucleation sites, as the lower boiling point fluid typically does not undergo a phase change. That is, it may be desirable to use the inserts 46 in alternate plate pairs 32, 34. For example, FIG. 10 shows a heat exchanger cross-section with a mesh insert 46 inserted only between each of the plate pairs 32.

Figure 13:
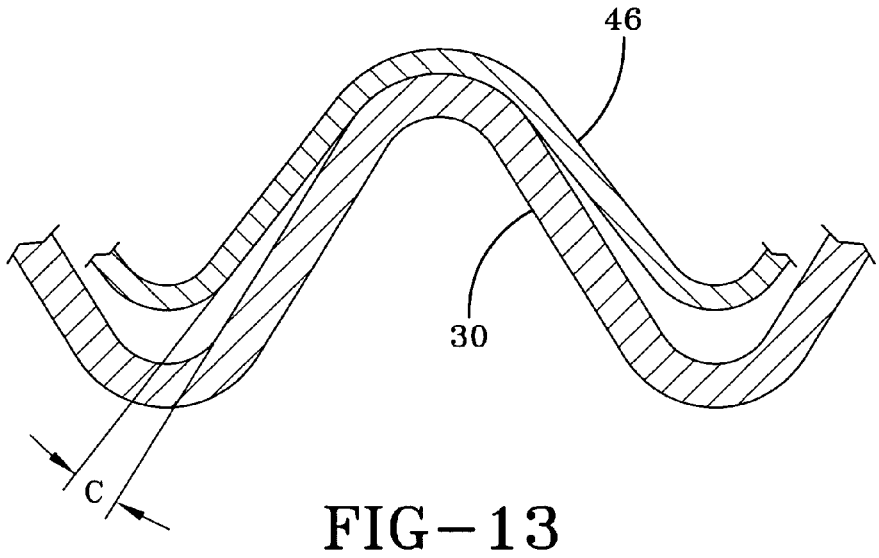
FIG. 13 is a cross-section of a single herringbone V-ridge of a plate heat exchanger and overlying mesh insert of the present invention taken along line 13—13 from FIG. 9 that is transverse to the direction of the V-ridge.
Figure 14:
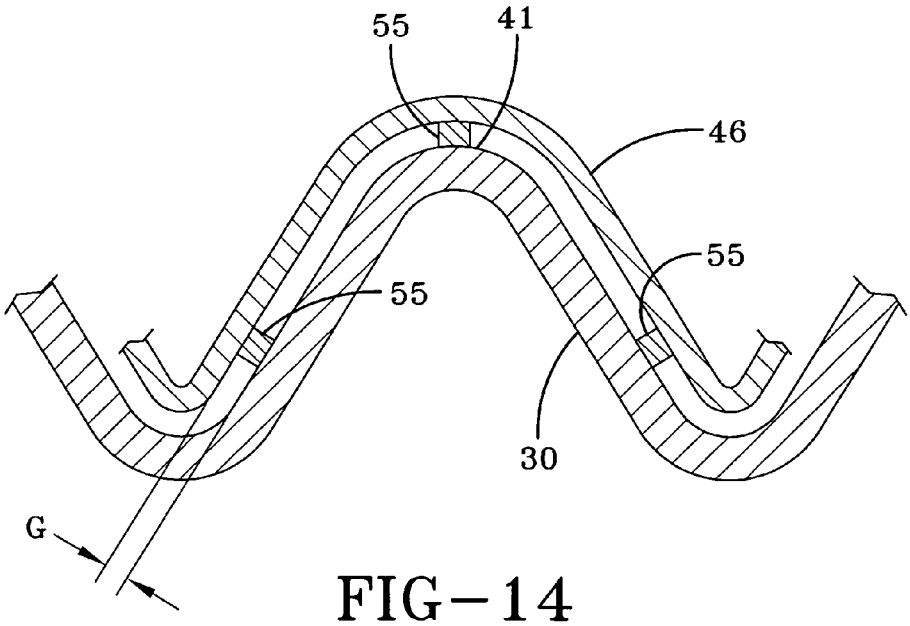
FIG. 14 is a cross-section of a single herringbone V-ridge of a plate heat exchanger and overlying mesh insert of the present invention taken along line 13—13 from FIG. 9 that is transverse to the direction of the V-ridge.

Alternately, mesh insert 46 or sheet/plate with perforated apertures may be configured to provide a gap between the surface of the mesh insert 46 and the corresponding surface of the plate 28, 30. In other words, the mesh insert 46 at least partially extends away from the surface of the plate 28, 30 so that at least a portion of the surfaces of the mesh insert 46 is exposed to the flow stream of fluid. Referring to FIG. 13, this flow stream exposure may be provided by forming the mesh insert 46 so that upon installation of the mesh insert on the surface of the plate 30, the facing surfaces between the mesh insert 46 and the plate 30 define an angular separation of "C" degrees, or fractions of a single degree, if desired. An alternate embodiment, referring to FIG. 14, the profiles defined by each of the mesh insert 46 and the plate 30 are substantially identical. The gap between the surfaces of the mesh insert 46 and the plate 30, designated "G", may be formed by a plurality of spacers 55 that, at the least, preferably appear adjacent a plurality of apexes 41 of the plate 30 and are of sufficient number to maintain the minimum gap "G" therebetween. Alternately, or in combination with the arrangement of spacers 55 adjacent to the apexes 41, the spacers 55 may be arranged at positions other than adjacent the apexes 41 sufficient to maintain the minimum gap "G" between the facing surfaces of the plate 30 and the mesh insert 46. The spacers may be formed integral to the mesh insert 46, which is preferable, or integral to the plates. The spaces may be separate parts, but must be anchored into position to prevent drift as fluid flows.

The mesh 46 or perforated apertures of the present invention, provides the surface microfeatures for enhanced heat transfer by promoting bubble formation as previously described. The mesh size required to produce the desired bubble formation is primarily a function of the type of refrigerant used, but may also be affected by any one or more of the following: the flow rate of the fluid; the desired heat transfer coefficient; the pressure of the fluid; or temperature of the fluid. Pressure and temperature also may affect the surface tension or viscosity of the fluid. For conventional refrigerants, such as R22, R410a, R407c, R717, R134 and other halocarbons and conventional fluids and most fluid flow rates and conditions encountered, mesh sizes from about 400 mesh to about 20 mesh corresponding to openings of from about 0.002 inches to about 0.050 inches may be used. Typically, a mesh is comprised of mutually transverse, interwoven, uniformally spaced members. Thus, the term "mesh opening" typically refers to the distance between adjacent parallel members, although if the mesh members are not mutually transverse, the mesh openings would correspond to the narrower of the two diagonal distances of a "diamond shaped" mesh opening defined by a combined pair of interwoven mesh members. Since conventional refrigerants contain various concentrations and types of lubricating oil, reducing the openings below about 0.002 inches appears to trap droplets of lubricating oil that typically are found mixed with liquid refrigerant, thereby preventing bubble formation. For perforated apertures, the size of the diameter (for circular apertures) or side (for rectangular or triangular openings) is about 0.002 to about 0.050 inches. For openings of about 0.002 inches and larger, the lubricating oil is flushed from the openings by the flow of the fluid through the heat exchanger. It is appreciated that the combination of refrigerant and oil systems, such as miscible versus nonmiscible, may affect the size openings, and as systems become available requiring no lubricating oil, openings of about 0.0001 inches may be possible, especially if other non-fluorocarbon fluids are used, such as ammonia, liquid nitrogen, $CO_2$, etc., the minimum opening size being dictated by the oil, whether it is trapped by the openings and the extent to which it is trapped.

Alternately, stacked mesh layers have been used, such as, for example, a 100 mesh layer placed over a 400 mesh layer so that the 100 mesh layer is positioned in the flow path or flow channel between the heat transfer plate forming the boundary between the fluids and the 400 mesh layer. This can increase performance by trapping bubbles adjacent the plate. While it is possible to have two stacked 400 mesh layers, maintaining a top mesh layer with larger openings provides increased fluid flow to the bottom mesh layer to more effectively flush bubbles from openings in the bottom 400 mesh layer. It may also be possible to combine more than two mesh layers, such as a 400 mesh layer adjacent to a first 100 mesh layer which is adjacent a second 100 mesh layer, depending upon the many combinations of refrigerants and operating conditions.

Although the mesh arrangements, as discussed above, will work with nonbrazed heat exchanger constructions, problems are encountered when attempting to use mesh inserts with brazed heat exchanger constructions. In brazed heat exchanger constructions, the molten copper from the copper foil layers during the blazing operation flows into the openings in the mesh via capillary action, clogging these openings, which interferes with enhanced nucleation at the surface. However, forming or applying an oxide coating, such as nickel oxide or chromium oxide, aluminum oxide, zirconium oxide and other oxides, on the mesh insert 46 prior to its insertion in the heat exchanger, appears to prevent the molten copper from flowing into the mesh openings while allowing a bond to be formed in the node areas 42 through the apertures 52. In other words, after an oxide coating has been formed on the mesh insert 46, and the insert 46 inserted between adjacent plates and heated as described above, the molten braze metal, such as copper, flows through the apertures 52 to form a brazed joint at nodes 42 between alternating apexes 41 of the plates 28, 30, without molten copper flowing into and clogging the mesh openings. Alternately, it is contemplated that other coatings or surface treatments may be applied to the mesh insert 46 that are compatible with the fluids to prevent the flow of molten braze metal into the mesh openings.

One method of making the present embodiment is to form the mesh from a high alloy material such as stainless steel in sheet form, which is then oxidized to form nickel oxide or chromium oxide or combinations thereof. The oxidized stainless steel can then be rolled onto a thin sheet 50 of unoxidized stainless steel and apertures 52 can be formed therein. In another embodiment, the mesh 46 and the steel sheet 50 may have the apertures 52 formed in them, and then the mesh 46 (after oxidization) and steel sheet 50 are precision assembled and rolled. To stabilize the mesh 46, the steel sheet 50 may extend past the opposed edges of the mesh 46 and then folded over the mesh 46. Any other method of forming the stainless steel sheet may be used, such as stamping. Additionally, the sequence of operation is not significant, as long as the mesh has a surface that resists the flow of molten copper via capillary action. Alternatively, the oxide coating may be applied to the mesh screen by any convenient processes such as spraying, painting, vapor deposit, screen printing etc. For example, a thin coating of nickel may be deposited, for example by an electrolyte process which is then oxidized. Any other plating or coating method may also be used.

Figure 16:
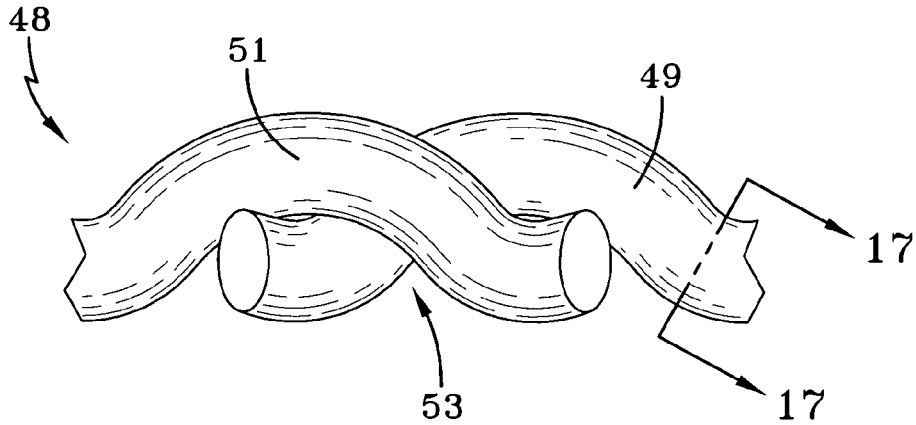
FIG. 16 is a partial perspective view of a mesh insert of the present invention.
Figure 17:
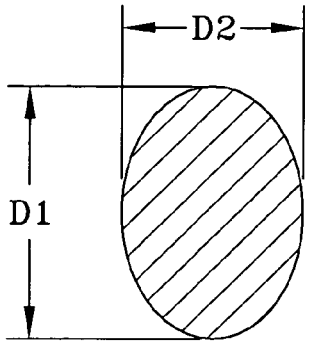
FIG. 17 is a cross-section of a member of a mesh insert of the present invention.

Referring to FIG. 16, the mesh 48 typically includes a plurality of mutually transverse interwoven members 49, 51 to construct the mesh 48. By virtue of the interwoven arrangement of the members 49, 51 alternately passing both over and under each other, at each juncture between the members 49, 51 adjacent a position where one member, such as member 51, passes over the corresponding member 49, defines a recess 53. Depending upon the dimensions of the members 49, 51, which typically are of circular cross-section, the recesses 53 may provide additional favorable locations for bubble formation. Alternately, referring to FIG. 17, the cross-section of transverse members 49, 51 may be non-circular, such as an oval having a dimension Dl in one direction, and a dimension D2 in a direction that is perpendicular to the first dimension. The cross-section of the transverse members 49, 51 may define virtually any cross-section having a closed geometric shape and any orientation or combination of geometric shapes between the transverse members 49, 51. Further, the cross-sectional profiles of the transverse members 49, 51 may differ depending on the location of the mesh 46 within the plate heat exchanger 10 as portions of the mesh 48 may be subjected to different phases or physical states of fluid, including, liquid and or a liquid/vapor mixture to provide enhanced heat transfer to such fluids.

Figure 15:
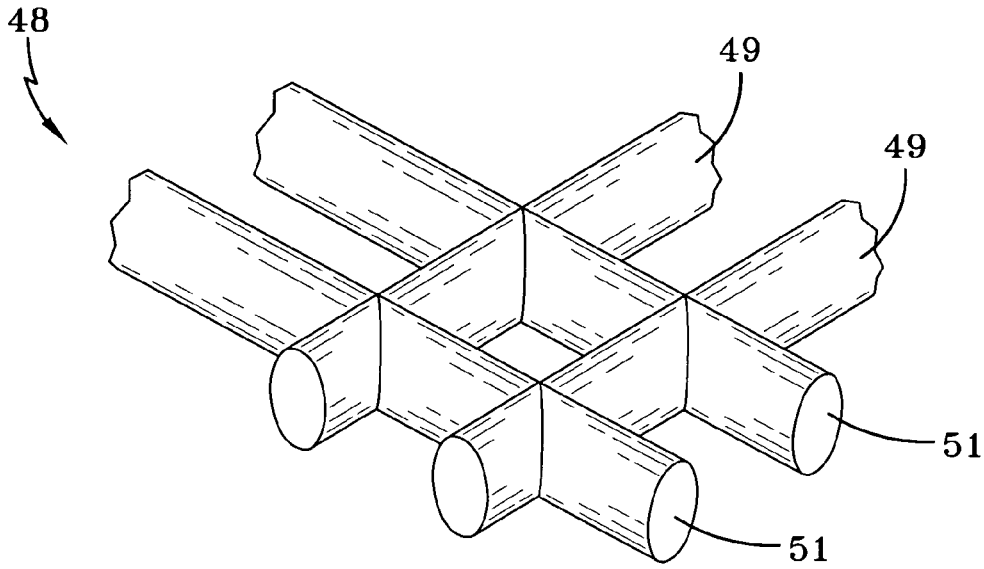
FIG. 15 is a partial perspective view of a unitary construction of the mesh insert of the present invention.

FIG. 15 depicts an alternate unitary mesh 48 construction of transverse members 49, 51. It is contemplated that this unitary construction may also incorporate all the variations of cross-section and varying cross-section as previously discussed for the interwoven mesh construction and, if the plates are to be joined by a mechanical fastening means rather than brazing, the mesh may be comprised of a polymeric material such as a synthetic that is readily woven. Thus, for example, nylon may be used. However, it is also contemplated that for any of these mesh constructions, transverse members 49, 51 are not required to be mutually perpendicular, and may be arranged in any orientation with respect to the longitudinal direction, typically the greater dimension of a rectangular plate heat exchanger, if desired.

Figure 11:
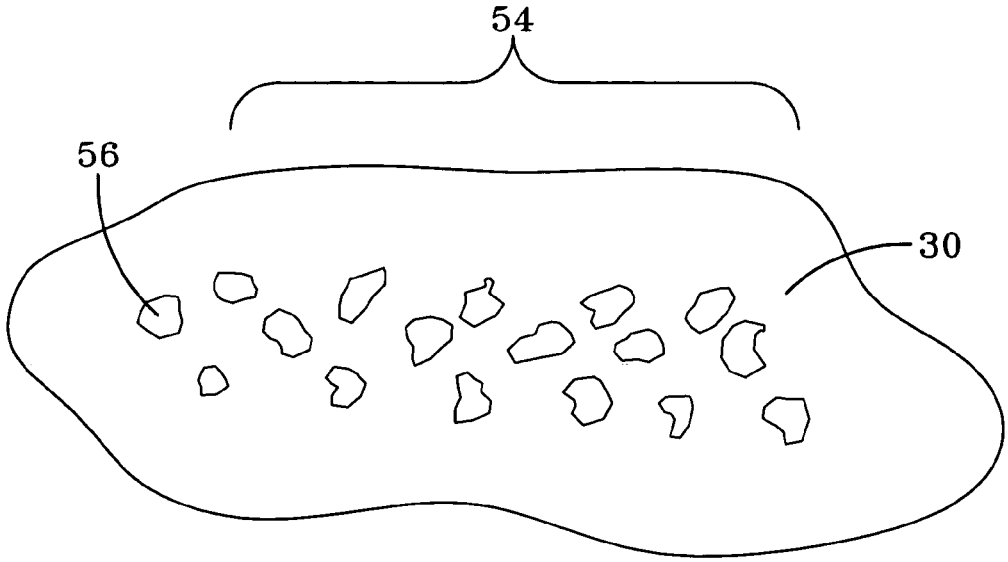
FIG. 11 is an enlarged partial plan view of a surface microfeature arrangement in association with a heat exchanger plate of the present invention.
Figure 12:
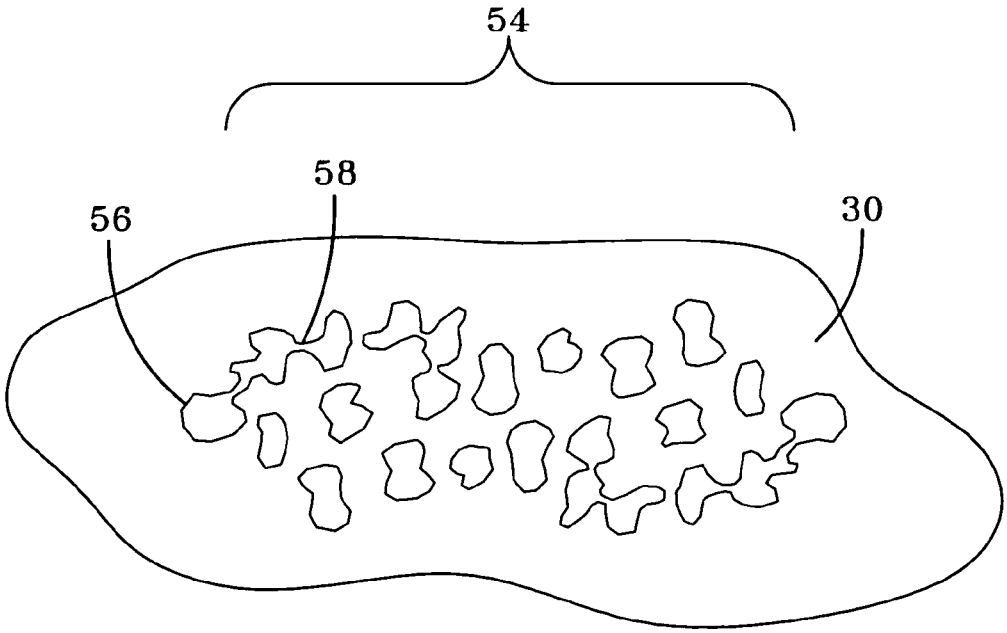
FIG. 12 is an enlarged partial plan view of an alternate surface microfeature arrangement in association with a heat exchanger plate of the present invention.

In another embodiment of the present invention, instead of employing a mesh insert 46, it may be desirable to form the heat exchanger plate surface microfeatures directly on or in the plates 28, 30 or a combination of both, or a combination of both forming the surface microfeatures directly on and in the plates 28, 30. Referring to FIG. 11, microfeatures 56 are shown formed in at least a portion of the plate surface, such as plate 30, sized within the range as previously discussed and spaced to provide enhanced heat transfer. The microfeatures 56 may be of any geometric attribute or shape, including but not limited to, for example, circular, triangular, diamond, etc., although the microfeatures 56 may have interconnections 58 (FIG. 12) between adjacent microfeatures 56, which interconnections 58 may additionally provide a favorable location for enhanced heat transfer as previously discussed. Such interconnections 58 may be considered, at least locally, as defining an open geometric shape.

The microfeatures 56 may be formed in the plates 28, 30 in any number of ways. For example, the desired microfeatures 56 may be formed in the press dies so that upon stamping the plates 28, 30, the microfeatures 56 may be formed. Alternately, a wheel or other forming device having the desired microfeatures 56 may be placed in rolling contact with the plates 28, 30 under sufficient force to form indentions in the surface of the plates 28, 30, which indentions formed in the plates 28, 30 being configured such that the desired microfeatures 56 of the present invention are achieved upon the subsequent stamping by the press dies. It is further contemplated that a layer of copper foil may be applied prior to use of the forming device, which form indentions into or through the copper foil layer, then into the plate surface, since the ductile copper foil layer acts as a lubricant during the formation of microfeatures 56. It is also contemplated in a brazed plate heat exchanger that a layer of material have the microfeatures 56 formed through the thickness of the material layer and then securing the material layer to a backing layer, which material layer being subjected to a mask application that substantially corresponds to the locations of the microfeatures 56, which mask resisting the flow of molten copper into the microfeatures 56. Alternatively, laser etching, controlled bombardment with particles under pressure, chemical etching, or any other device or method known in the art may be used to achieve the microfeatures 56. It may also be possible to subject the plates, or raw plate material to a heat treatment which could also form the microfeatures 56 in the surface of the plates or raw plate material. The heat treatment may also form the microfeatures 56 in a coating applied to the plates or raw plate material prior to the heat treatment. This heat treatment includes the possibility of modifying or substituting the preferred plate material, such as a stainless steel, with an alloy or even an alternate material and/or coating layer to achieve the microfeatures 56.

The microfeatures 56 may also be formed by methods that add material to the plates 28, 30, such as by deposition by plasma spray, powder spray or vapor deposition. For example, applying a material, such as an oxide protective scale, either as a metal which is subsequently oxidized or directly as an oxide, in the appropriate form, such as a powder, in liquid or vapor solution or suspension, preferably after assembly of the heat exchanger 10, then providing a chemical solution and the appropriate catalyst, if required, such as heat, and/or pressure, or passing electrical current through the plates to bring about the deposition of material to the surface of the plates 28, 30 to form the microfeatures 56. Additionally, the material can be selectively deposited in the required locations by the use of these techniques by use of masks, which are subsequently removed. The applied material need not be metal, so long as the surface microfeatures 56 provide enhanced heat transfer coefficients. In other words, for purposes herein, the term "surface microfeatures" may apply not only to a geometric arrangement that is pressed into the surface, such as a pressing die, but may also apply to processes that result in the formation of the surface microfeatures by depositing additional material at preselected sites on the surface of the plates as well as inserts inserted into flow passages between plates. Although it may be preferable to have an arrangement of microfeatures 56 substantially formed in a pattern that promotes enhanced heat transfer for a majority of fluids and operating conditions, providing microfeatures 56 in a non-patterned or random arrangement is also contemplated.

The invention also improves the heat transfer rate of mixed plate combinations, where a 30 degree angle V-ridge (FIG. 5), also referred to as a chevron, is paired with a 60 degree V-ridge, as an example. This allows for higher heat transfer coefficients while providing lower fluid side pressure drops. In conventional applications, this combination of mixed plate and enhanced surface can lower the cost of manufacturing, while providing the desired pressure drops for typical applications.

Furthermore, when operating the heat exchanger refrigerant side in a partially or fully flooded evaporating mode, this low pressure drop feature, combined with the enhanced surface can significantly improve the overall heat transfer performance, and make flooded mode applications more practical and improve performance. Where in the past, plate heat exchangers have been limited to generally to approach temperatures in the range of 9° F. to 4° F. between refrigerant evaporating temperature and leaving secondary fluid temperature, due to overall heat transfer coefficient limitation and gas side pressure drop which suppresses the evaporating temperature. With the enhanced surface and mixed plate combination, approach temperatures in the range of 4° F. to less than ½° F. are possible.

In refrigerant applications such as R717, ammonia, used widely in industrial refrigeration systems, this mixed plate combination with enhanced surface microfeatures is highly desirable in that lower refrigerant side pressure drops is important to allow the expanding gas to exit, while maintaining a close approach temperature between the refrigerant and leaving secondary fluid temperature. Thus, in some applications, this mixed plate combination and enhanced surface has advantages for the refrigeration system designer.

It is appreciated that the enhanced heat transfer surface of the present invention is not limited to heating and refrigeration applications and may also be used in cleaning fluids, $CO_2$ systems, cryogenic systems, and any other applications requiring compact, efficient, thermal communication between at least two fluids maintained in separated flow passages.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A plate heat exchanger comprising:

a plurality of plates, each plate having opposed surfaces and perimeter flanges, for providing at least one flow path for each of at least two fluids, wherein facing surfaces and perimeter flanges of a pair of adjacent plates of the plurality of plates define a flow path for each fluid of the at least two fluids, and wherein opposed surfaces of at least one plate of each pair of adjacent plates provides a flow path boundary for two fluids of the at least two fluids, the at least one plate having a high thermal conductivity and providing a portion of the flow path boundary for two fluids of the at least two fluids, thereby providing thermal communication between the two fluids on the opposed surfaces of the plate;

an inlet and outlet for each fluid of the at least two fluids, the inlet and outlet for each fluid being in fluid communication with each flow path for said fluid;

at least one insert member having a plurality of surface microfeatures, the plurality of microfeatures includes a plurality of apertures formed therein, each aperture corresponding to a nodal contact between facing surfaces of the adjacent plates of the plurality of plates, the at least one insert member disposed in fluid communication with at least a portion of at least one flow path for at least one fluid, facing surfaces of the at least one insert member and one of the pair of adjacent plates of the plurality of plates being substantially immediately adjacent, the plurality of surface microfeatures for providing enhanced heat transfer between the at least two fluids, the at least one plate forming a portion of the flow path boundary.

2. The plate heat exchanger of claim 1 wherein the plurality of surface microfeatures have geometric attributes.

3. The plate heat exchanger of claim 1 wherein the plurality of surface microfeatures correspond to openings sufficiently large to prevent entrapment of a lubricating oil.

4. The plate heat exchanger of claim 1 wherein the plurality of surface microfeatures correspond to openings from about 0.002 inches to about 0.050 inches.

5. The plate heat exchanger of claim 1 wherein the plate heat exchanger is of brazed construction comprising the insertion of at least one foil plate between the adjacent plates of the plurality of plates, the at least one foil plate becoming molten and flowing between adjacent plates of the plurality of plates to form brazed nodal contacts between facing surfaces of the adjacent plates of the plurality of plates when the plate heat exchanger is heated to a predetermined temperature below the melting point of the adjacent plates of the plurality of plates, but above the melting temperature of the at least one foil plate, the at least one insert member having a coating layer applied to the surfaces of the at least one insert member to substantially prevent molten metal from the foil plate from flowing into the plurality of microfeatures of the at least one insert member.

6. The plate heat exchanger of claim 5 wherein the coating layer is an oxide coating.

7. The plate heat exchanger of claim 1 wherein the coating layer is an oxide coating selected from the group consisting of nickel oxide, chromium oxide, aluminum oxide, and zirconium oxide or combinations thereof.

8. The plate heat exchanger of claim 1 wherein the at least one insert member is an insert plate.

9. The plate heat exchanger of claim 1 wherein the at least one insert member is a mesh.

10. The plate heat exchanger of claim 9 wherein the mesh is of unitary construction.

11. The plate heat exchanger of claim 10 wherein the cross sectional profile of a member of the mesh is non-circular.

12. The plate heat exchanger of claim 9 wherein the mesh includes a backing layer.

13. The plate heat exchanger of claim 12 wherein the backing layer is comprised of a metal.

14. The plate heat exchanger of claim 9 wherein the cross sectional profile of a member of the mesh is non-circular.

15. The plate heat exchanger of claim 9 wherein the mesh comprises a plurality of stacked mesh layers.

16. The plate heat exchanger of claim 15 wherein the plurality of stacked mesh layers is about a 400 mesh first layer and about a 100 mesh second layer.

17. The plate heat exchanger of claim 15 wherein the plurality of stacked mesh layers is about a 400 mesh first layer and about a 400 mesh second layer.

18. The plate heat exchanger of claim 15 wherein the plurality of stacked mesh layers is about a 400 mesh first layer, about a 100 mesh second layer and about a 100 mesh third layer.

19. A plate heat exchanger comprising:

a plurality of plates, each plate having opposed surfaces and flanges, for providing at least one flow path for each of at least two fluids, wherein facing surfaces and perimeter flanges of a pair of adjacent plates of the plurality of plates define a flow path for each fluid of the at least two fluids, and wherein opposed surfaces of at least one plate of each pair of adjacent plates provides a flow path boundary for two fluids of the at least two fluids, the at least one plate having a high thermal conductivity and providing a portion of the flow path boundary for two fluids of the at least two fluids, thereby providing thermal communication between the two fluids on the opposed surfaces of the plate;

an inlet and outlet for each fluid of the at least two fluids, the inlet and outlet for each fluid being in fluid communication with each flow path for said fluid; and at least one insert member having a plurality of surface microfeatures, wherein the at least one insert member is a mesh, the mesh including a backing layer, wherein the backing layer extends past opposed edges of the mesh and then folds over the opposed edges, the at least one insert member disposed in fluid communication with at least a portion of at least one flow path for at least one fluid, facing surfaces of the at least one insert member and one of the pair of adjacent plates of the plurality of plates being substantially immediately adjacent, the plurality of surface microfeatures for providing enhanced heat transfer between the at least two fluids, the at least one plate forming a portion of the flow path boundary.

20. A plate heat exchanger comprising:

a plurality of plates, each plate having opposed surfaces and perimeter flanges, for providing at least one flow path for each of at least two fluids, wherein facing surfaces and perimeter flanges of a pair of adjacent plates of the plurality of plates define a flow path for each fluid of the at least two fluids, and wherein opposed surfaces of at least one plate of each pair of adjacent plates provides a flow path boundary for two fluids of the at least two fluids, the at least one plate having a high thermal conductivity and providing a portion of the flow path boundary for two fluids of the at least two fluids, thereby providing thermal communication between the two fluids on the opposed surfaces of the plate;

an inlet and outlet for each fluid of the at least two fluids, the inlet and outlet for each fluid being in fluid communication with each flow path for said fluid;

at least one insert member having a plurality of surface microfeatures, the at least one insert member being a mesh having openings from about 0.0001 inches to about 0.050 inches, the at least one insert member disposed in fluid communication with at least a portion of at least one flow path for at least one fluid, facing surfaces of the at least one insert member and one of the pair of adjacent plates of the plurality of plates being substantially immediately adjacent, the at least one insert member having a profile substantially conforming to at least one of the pair of adjacent plates, the plurality of surface microfeatures for providing enhanced heat transfer between the at least two fluids, the at least one plate forming a portion of the flow path boundary.

21. A plate heat exchanger comprising:

a plurality of plates, each plate having opposed surfaces and perimeter flanges, for providing at least one flow path for each of at least two fluids, wherein facing surfaces and perimeter flanges of a pair of adjacent plates of the plurality of plates define a flow path for each fluid of the at least two fluids, and wherein opposed surfaces of at least one plate of each pair of adjacent plates provides a flow path boundary for two fluids of the at least two fluids, the at least one plate having a high thermal conductivity and providing a portion of the flow path boundary two fluids of the at least two fluids, thereby providing thermal communication between the two fluids on the opposed surfaces of the plate;

an inlet and outlet for each fluid of the at least two fluids, the inlet and outlet for each fluid being in fluid communication with each flow path for said fluid;

at least one insert member having plurality of surface microfeatures, the at least one insert member being a mesh having openings from about 0.0002 inches to about 0.050 inches, the at least one insert member disposed in fluid communication with at least a portion of at least one flow path for at least one fluid, facing surfaces of the at least one insert member and one of the pair of adjacent plates of the plurality of plates being substantially immediately adjacent, the at least one insert member having a profile substantially conforming to at least one of the pair of adjacent plates, the plurality of surface microfeatures for providing enhanced heat transfer between the at least two fluids, the at least one plate forming a portion of the flow path boundary.

* * * * *

UNITED STATES PATENT AND TRADEMARK OFFICE

CERTIFICATE OF CORRECTION

PATENT NO. : 7,032,654 B2
APPLICATION NO. : 10/643689
DATED : April 25, 2006
INVENTOR(S) : Wand et al.

It is certified that error appears in the above-identified patent and that said Letters Patent is hereby corrected as shown below:

Column 15, line 27, “and flanges,” should be --and perimeter flanges,--.

Column 16, line 48, “about 0.0002 inches” should be --about 0.002 inches--.

Signed and Sealed this

Eleventh Day of July, 2006

JON W. DUDAS
*Director of the United States Patent and Trademark Office*